US005926846A

United States Patent [19]

Segal

[11] Patent Number: 5,926,846

[45] Date of Patent: Jul. 27, 1999

[54] SAFETY GARMENT

[76] Inventor: Amy R. Segal, 83 Allerton Rd., Newton, Mass. 02159

[21] Appl. No.: 09/041,158

[22] Filed: Mar. 12, 1998

[51] Int. Cl.[6] ..... A41D 11/00; A41D 1/04

[52] U.S. Cl. ..... 2/102; 2/111

[58] Field of Search ..... 2/102, 104, 111, 2/80, 94, 69.5, 114, 83, 338; 224/159, 160; 119/770, 857; 128/874, 873, 875; 297/465

[56] References Cited

U.S. PATENT DOCUMENTS

| | | | |
|---|---|---|---|
| 2,316,602 | 4/1943 | Lee | 2/111 |
| 2,411,331 | 11/1946 | Nettleship | 224/159 |
| 2,424,000 | 7/1947 | Shanker | 2/52 |
| 2,628,358 | 2/1953 | Neils | 2/69.5 |
| 2,635,245 | 4/1953 | Nigro | 2/80 |
| 2,908,324 | 10/1959 | Muller et al. | 2/102 |
| 3,407,807 | 10/1968 | Giberson | 2/114 |
| 3,575,326 | 4/1971 | Chappell | 224/6 |
| 3,769,938 | 11/1973 | Hudziak et al. | 119/96 |
| 4,429,419 | 2/1984 | Snyder | 2/102 |
| 4,667,624 | 5/1987 | Smith . | |
| 4,981,110 | 1/1991 | Llewellyn . | |
| 5,002,270 | 3/1991 | Shine | 2/102 |
| 5,161,258 | 11/1992 | Coltrain | 2/102 |
| 5,183,007 | 2/1993 | Vincent . | |
| 5,246,152 | 9/1993 | Dotseth | 224/159 |
| 5,301,371 | 4/1994 | Chao | 2/102 |
| 5,570,823 | 11/1996 | Lindy | 224/160 |
| 5,692,456 | 12/1997 | Louks-Phillips . | |
| 5,772,088 | 6/1998 | Nelson | 224/160 |

*Primary Examiner*—Amy Vanatta
*Attorney, Agent, or Firm*—Choate, Hall & Stewart

[57] ABSTRACT

Safety vest for use in turbulent environments. The vest is made of a breathable material and sized to fit a child. A strap is securely affixed to the vest and sized to encircle a person so that the vest and a child wearing the vest may be secured to the person. The use of the vest will prevent a child from being ripped from a parent's arms during, for example, severe air turbulence.

1 Claim, 3 Drawing Sheets

SAFETY GARMENT

BACKGROUND OF THE INVENTION

This invention relates to a safety garment and more particularly to a vest to be worn by a child which is securely attached to another person such as an adult.

Children under two years of age are permitted to travel on commercial airliners without purchasing a seat so long as they are on the lap of a parent or other adult. Children over two years of age must purchase a seat but nonetheless often spend time during a lengthy flight on a parent's lap. While the parent will be restrained by a seat belt upon take-off and landing and at other times such as during periods of turbulence, a child in a parent's lap is restrained only by the parent's arms.

It is well documented that commercial airliners may be subjected to large vertical accelerations often caused by severe turbulence with little or no forewarning. Such turbulence may cause the airplane to accelerate downwardly at a high rate. Objects, including passengers, which are unrestrained may suffer an impact with the ceiling of the passenger cabin. For example, in December 1997 a commercial airliner bound for Hawaii from Japan encountered sudden turbulence while flying over the Pacific Ocean at 33,000 feet. As passengers were preparing to eat a meal the plane suddenly descended. Unrestrained objects hit the ceiling including one woman who died of her injuries and sixty others who were injured.

It is highly likely that had there been a child sitting on a parent's lap during this tragic event, the child would have been ripped from the parent's arms and severely injured if not killed. The present invention provides a secure attachment of a child to a parent or other adult.

SUMMARY OF THE INVENTION

The safety garment of the invention includes a vest made of a breathable material and sized to fit a child. A strap securely affixed to the vest is sized to encircle a person so that the vest and a child wearing the vest are secured to the person. In one embodiment, the vest includes a torso portion and a lower portion adapted to extend through the child's legs and to attach to the torso portion. The strap may include a longer segment and a shorter segment with the segments including releasable attachment apparatus for fastening the longer and shorter segments together.

The torso portion of the vest may also include a pocket for receiving the longer segment of the strap when the segments are unattached. The torso portion of the vest may open in the front or from the rear and is secured with clips. Adjustment straps may be provided for altering the fit of the vest to assure a snug fit on the child. One embodiment includes an attachment device affixed to the vest for holding another object such as a pacifier.

A child wearing the vest of the invention is thus securely attached to a parent or adult person. If such person is her or himself wearing a seat belt, the safety garment of the invention will prevent a child from being ripped from the grasp of the adult and thereby prevent injury.

DESCRIPTION OF THE PREFERRED EMBODIMENT

Figure 1:
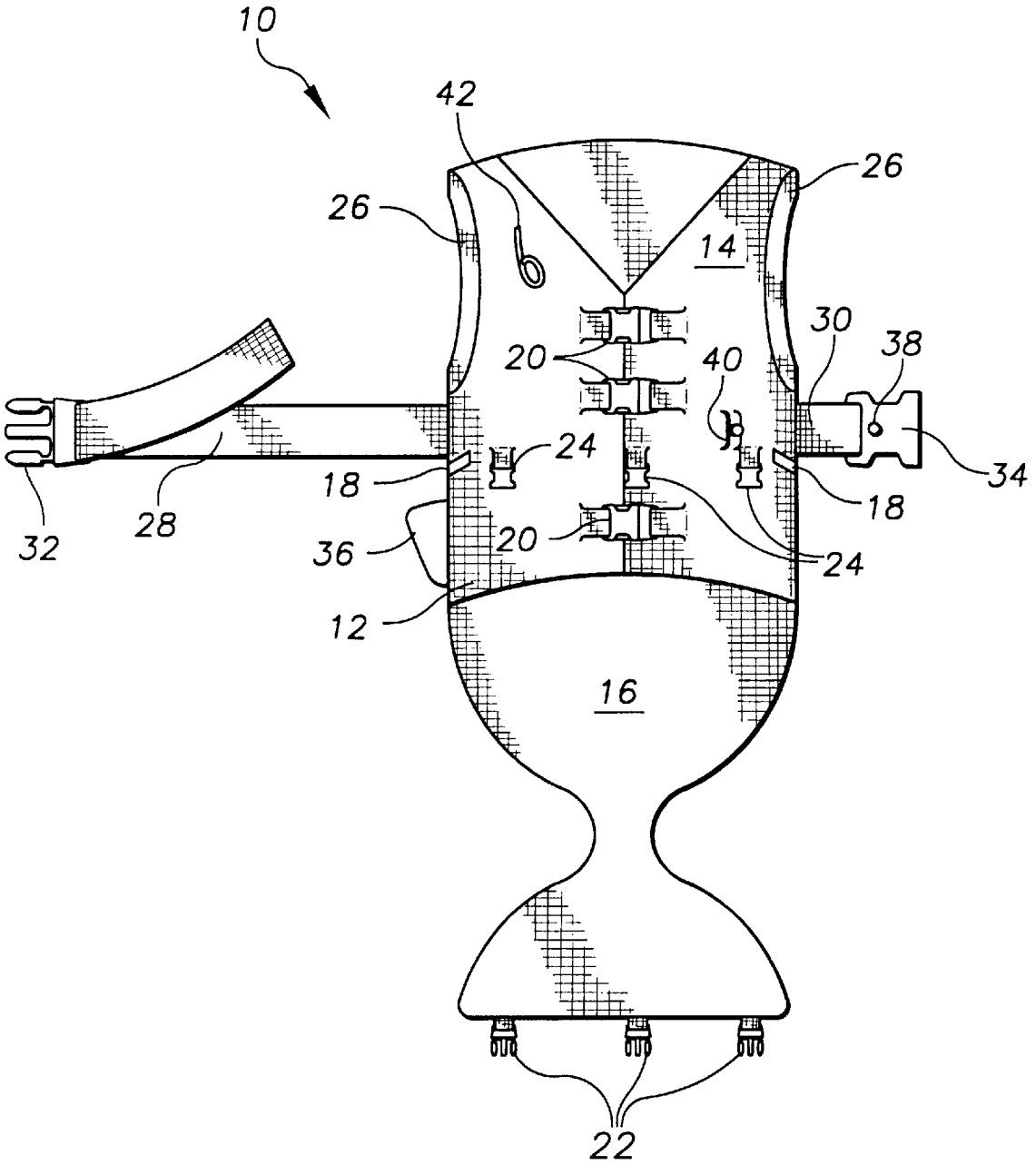
FIG. 1 is a front view of the safety garment of the invention.
Figure 2:
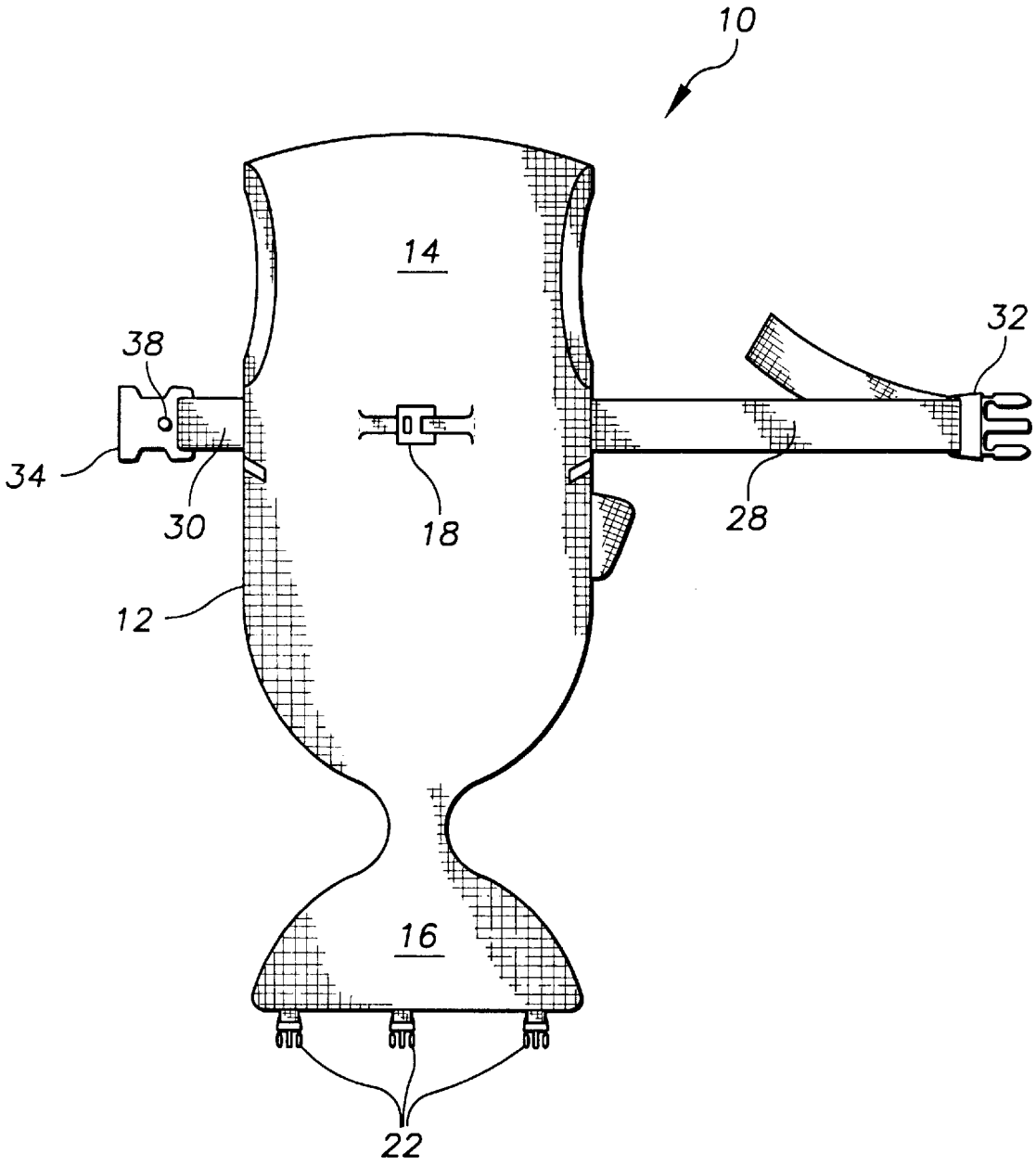
FIG. 2 is a rear view of the safety garment of the invention.
Figure 3:
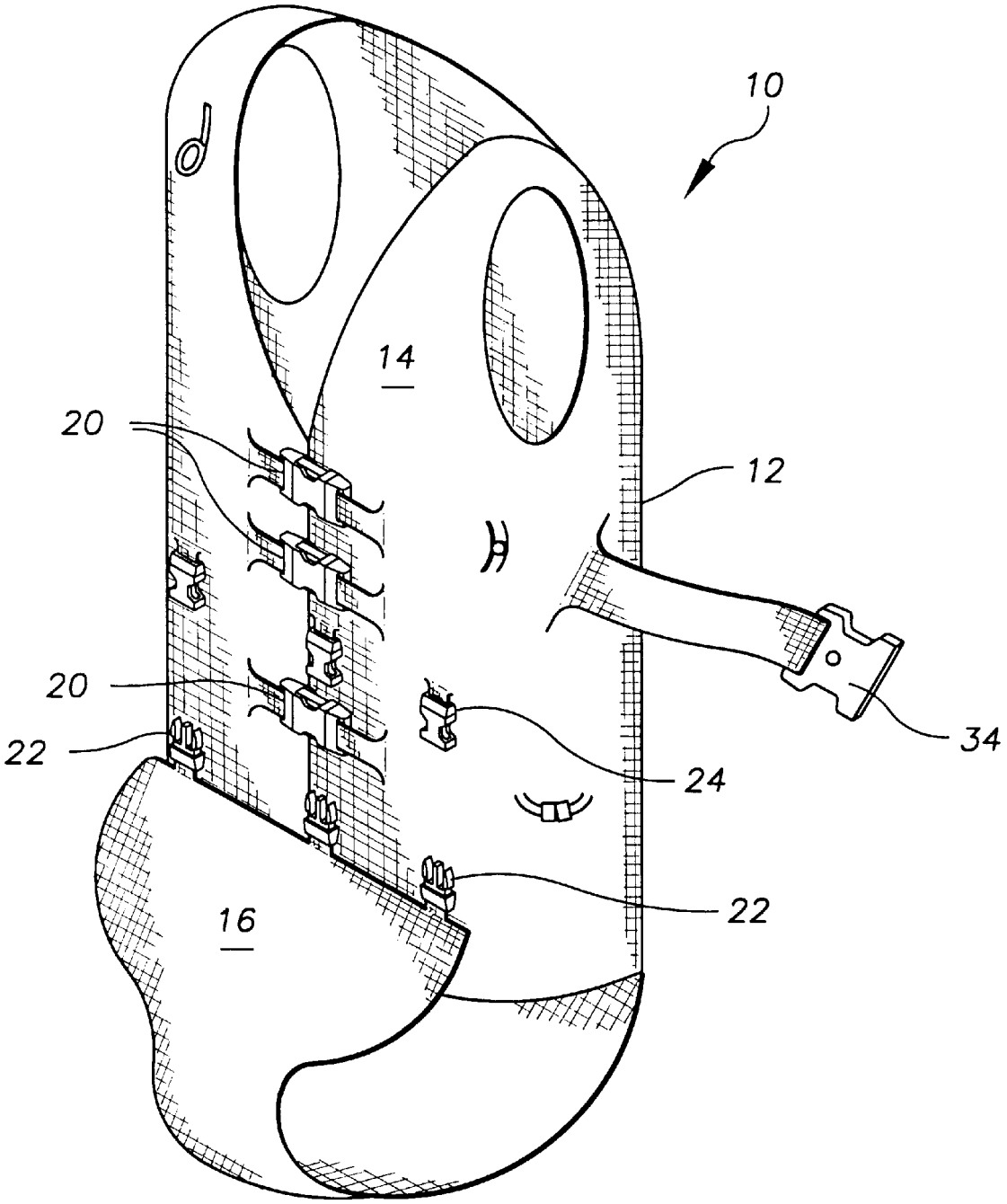
FIG. 3 is a perspective view of the safety garment of the invention.

With reference to the three figures of the drawing, a safety garment 10 includes a vest 12. The vest 12 includes a torso portion 14 and a lower portion 16. The torso portion 14 and lower portion 16 are preferably made of a lightweight, breathable cloth material and may be provided in bright colors so as to be appealing to a child. The safety garment 10 is designed for use by infants, toddlers and children up to the age of 4–5 years. As will be appreciated, the safety garment 10 will come in a range of sizes to fit, for example, small infants, large infants, small toddlers and large toddlers. Adjustment straps 18 may be provided on the sides and back of the torso portion 14 which can be altered to provide a snug fit. The torso portion may open in the front as shown in FIGS. 1 and 3 or it may open in the rear (not shown). The front opening vest 12 is placed on a child (not shown) and is securely fastened shut with clips 20. It is preferred that the clips 20 be squeeze clips (sometimes referred to as parachute clips). Such clips have male and female portions which clip together and one portion must be squeezed with respect to the other to release.

The lower portion 16 of the garment 10 preferably has an hourglass shape as shown to facilitate passing between a child's legs. The lower portion 16 includes clips 22 which mate with receptacles 24 on the torso portion 14.

Attached to the torso portion 14 below arm openings 26 is a longer strap portion 28 and a shorter strap portion 30. The longer portion 28 may include a clip or buckle 32 which permits length to be adjusted. The combined length of the longer portion 28 and the shorter portion 30 is sufficient to encircle readily an adult-sized individual. The shorter segment 30 includes a receptacle 34 for receiving the buckle 32 for attaching the portions 28 and 30 together.

A pocket 36 in this embodiment will receive the longer portion 28 when the garment 10 is not in use. Similarly, the receptacle 34 on the shorter portion 30 includes a snap 38 which attaches to receiving portion 40 so that the shorter portion 30 may be secured out of the way when the garment 10 is not in use. It is preferred that the element 40 be mounted on a strip of material allowing one to place a finger behind the portion 40 so as to be able to snap the portions 38 and 40 together.

It is also preferred that the longer and shorter strap portions 28 and 30 be made of a very strong material such a three-inch wide nylon. The strap portions 28 and 30 may be permanently sewn to the vest 12 or removably attached with clips (not shown).

It will be appreciated that a child wearing the safety garment 10 is in the equivalent of a form-fitting jumpsuit that cannot pop open, ride up or cut into the child's waist. The present design will distribute forces substantially evenly over the child's body in the event of a jolt. This situation is unlike that which would occur if a child were wearing a seat belt. The abdominal muscles of young children cannot adequately support the impact of a seat belt in the abdomen area during a crash or sudden jolt.

To use the safety garment 10 of the invention, a child is placed into the vest 12 through, for example, a front opening and the clips 20 are securely fastened. The lower portion 16 is passed through the child's legs and the clips 22 are securely fastened into the receptacles 24. The adjustments straps 18 on the sides and back of the torso portion 14 are adjusted as necessary for a snug fit. The longer strap portion 28 is then passed around an adult and securely fastened to the shorter strap portion 30. Therefore, the vest 12 and the child wearing the vest are securely attached to an adult. It will be appreciated that the design permits the adult to attach and separate at will the longer strap portion 28 and the shorter strap portion 30, with no need to remove or adjust in any way the vest 12, once the vest 12 has been properly fitted onto the child. Optionally, the torso portion 14 may include an attachment device 42 which may loop around and support another object such as a pacifier (not shown). It will be appreciated that an adult may fasten the straps 28 and 30 with the child facing in any direction—forward, toward the adult, or sideways. The child may be sitting or cradled in the adult's arms. For younger children, diaper changes will require only the additional step of undoing the clips 22 from the receptacles 24 without having to remove the torso portion of the vest.

While it is contemplated that the present safety garment will have greatest utility in the context of air travel, it will be readily apparent that the invention may be used on other modes of public transportation which do not currently require children to be strapped in. Buses, trains, subways and boats often experience sudden jolts which might result in a child being thrown from a parent's lap. The present invention will keep the child securely attached to the parent. It should also be pointed out that the present safety garment in no way interferes with an adult's use of a seat belt in an airplane context.

It is recognized that modifications and variations of the present invention will be apparent to those skilled in the art. It is intended that all such modifications and variations be included within the scope of the appended claims.

What is claimed is:

1. Safety garment comprising:

a vest having a torso portion made of a breathable material and sized to fit a child; and a strap securely fixed to the vest, the strap sized to encircle a person whereby the vest and the child wearing the vest are secured to the person wherein the strap includes a longer segment and a shorter segment, the segments including releasible attachment means for fastening the longer and shorter segments together and further including snap means for securing the shorter segment of the strap to the torso portion of the vest.

* * * * *